United States Patent [19]

Wood

[11] Patent Number: 4,534,466

[45] Date of Patent: Aug. 13, 1985

[54] NESTABLE CONTAINER FOR PARTS STORAGE

[75] Inventor: Kenneth L. Wood, Santa Maria, Calif.

[73] Assignee: Republic Steel Corporation, Cleveland, Ohio

[21] Appl. No.: 640,246

[22] Filed: Aug. 13, 1984

Related U.S. Application Data

[63] Continuation of Ser. No. 381,184, May 24, 1982, abandoned.

[51] Int. Cl.[3] ..... B65D 21/02; B65D 25/06; B65D 25/28

[52] U.S. Cl. ..... 206/518; 206/520; 220/22.3; 220/71; 220/94 R

[58] Field of Search ..... 206/505, 506, 518, 519, 206/520; 220/22, 22.1, 22.2, 22.3, 71, 73, 94 R, 94 A

[56] References Cited

U.S. PATENT DOCUMENTS

| | | | |
|---|---|---|---|
| 1,221,789 | 4/1917 | Brown | 206/518 |
| 1,656,868 | 1/1928 | Davis | 220/22 |
| 1,954,224 | 4/1934 | Piker . | |
| 2,020,373 | 11/1935 | Petzold . | |
| 2,081,078 | 5/1937 | Watson . | |
| 2,314,729 | 3/1943 | Mursch | 220/94 R |
| 2,464,343 | 3/1949 | Praeger | 220/94 A |
| 2,550,804 | 5/1951 | Gordon | 206/506 |
| 2,619,251 | 11/1952 | Schmidt . | |
| 2,641,383 | 6/1953 | Coursey | 206/506 |
| 2,897,997 | 8/1959 | Sitler | 220/22.3 |
| 3,106,308 | 10/1963 | Kazimier . | |
| 3,207,359 | 9/1965 | Heisler . | |
| 3,219,196 | 11/1965 | Hare | 206/506 |
| 3,739,939 | 6/1973 | Koenig . | |
| 3,741,433 | 6/1973 | Bentley . | |
| 3,866,816 | 2/1975 | Bemiss . | |
| 4,372,444 | 2/1983 | Le Grand | 220/22.3 |

FOREIGN PATENT DOCUMENTS

| | | | |
|---|---|---|---|
| 651877 | 4/1951 | United Kingdom | 220/94 A |

*Primary Examiner*—George E. Lowrance

*Attorney, Agent, or Firm*—Watts, Hoffmann, Fisher & Heinke

[57] ABSTRACT

A nestable container is disclosed for use with automatic storage/retrieval systems. The container has a bottom wall and diverging side and end walls. The end walls have recessed areas integrally extending into the interior of the container. Engagement members are located completely within the recessed areas such that they do not protrude beyond a plane defined by the major portion of the end walls. An automatic storage/retrieval system engages the engagement member for the purposes of moving the container. The diverging side and end walls and the inboard engagement members make stacking of containers of the same size and dimensions possible. The side walls have recessed areas spaced from the bottom wall and extending into the interior of the container. The side wall recessed areas define a nesting stop to prevent similar containers from nesting too tight when stacked therein.

12 Claims, 11 Drawing Figures

NESTABLE CONTAINER FOR PARTS STORAGE

This application is a continuation of application Ser. No. 381,184, filed May 24, 1982, now abandoned.

DESCRIPTION

1. Technical Field

The present invention relates to storage containers and is particularly directed to a nestable storage container for use with automatic storage/retrieval systems.

2. Background Art

Automatic storage/retrieval systems utilize containers for the purpose of holding and storing items. In a container retrieval operation, a commandable crane moves along a programmed path to the location on a storage unit where the desired container is stored. With the prior art, the crane projects into and engages a channel protruding from the end of the container. The crane pulls the container onto a platform which is part of the crane. The crane then carries the container to a location where items are removed from or new items are placed in the container. The crane then transports the container back to its storage location where it pushes the container onto support tracks in the storage unit.

One problem with the prior art containers in automatic storage/retrieval systems is that they do not lend themselves to be nestable within other similar containers for shipment and container storage. Large trucks used to transport containers from one facility to another can ship typically up to 40,000 pounds. When the prior containers were loaded onto a truck and they were not nested one within another, not only was the 40,000 pound limit not acheived, but the number of shipped containers was less than if they could have been nested. One reason for the non-nestability of the prior art containers is that the handles protrude beyond the exterior walls of the container. Another reason for the non-nestability of the prior art containers is that the walls of the container are perpendicular with respect to the bottom wall. This prevents containers of the same size from being nested one within another.

Another shortcoming of prior parts containers is they have not fully utilized a storage volume. Those prior containers channels, known as handles, project from each end for engagement with the crane. Since the containers, other than the handles, are rectangular solids in shape, the space above the handle is not used for storage purposes.

DISCLOSURE OF THE INVENTION

The invention provides a new and improved container that is particularly adapted for use in automatic, parts storage/retrieval systems. The new container in accordance with the present invention is designed to permit coactable action with an automatic crane and to permit containers of the same size and dimension to be nested one within another for shipping and container storage purposes.

In the disclosed and preferred embodiments, the nestable container of the present invention includes a central element which is shaped to provide a base and spaced, diverging end walls fixed to and extending from the base. A spaced pair of diverging side walls are secured to the sides of the element to define a part receiving space.

The central element includes a spaced pair of recessed portions which interconnect the spaced end walls with the base. These recessed portions integrally extend into the interior of the container. A spaced pair of engagement members are each fixed to an associated one of the recessed portions to provide a spaced pair of engagement handles or slots, each adapted to receive a mechanical moving mechanism. Each of the side walls has a recessed rib portion spaced from the base and extending into the part receiving space. The rib portions act as nesting stops for a like container when nested therein. They also provide rigidity and accept dividers.

In the preferred embodiment, the engagement members are an inverted U shape. These engagement members are located completely within the recessed portions such that they do not protrude beyond the plane of the main exterior surface of the associated end wall. Accordingly, not only are the containers nestable but (a) the space above the recessed portion is available for parts storage, and (b) the engagement elements function to stiffen and reinforce the central element and therefore the container.

Another feature of the present invention is the provision that the top parts of the end and side walls are outwardly rolled to give the container extra rigidity.

Several advantages are realized by using the container made in accordance with this invention over the prior art devices. One advantage realized is that each container is nestable within like containers. This nestability feature of the containers made in accordance with the present invention permits a multitude of containers to be transported or shipped with less room than would be required to ship unnestable containers. Containers so nested for shipment purposes, adds extra rigidity to the overall structure of the containers thus minimizing damage caused by shipment.

Another advantage of the container of the present invention is that the inboard handle structure and the outwardly rolled ends of the end and side walls add rigidity to the overall structure.

Other features and advantages and a fuller understanding of the invention will be had from the following detailed description and the accompanying drawings.

BEST MODE OF CARRYING OUT THE INVENTION

Figure 1:
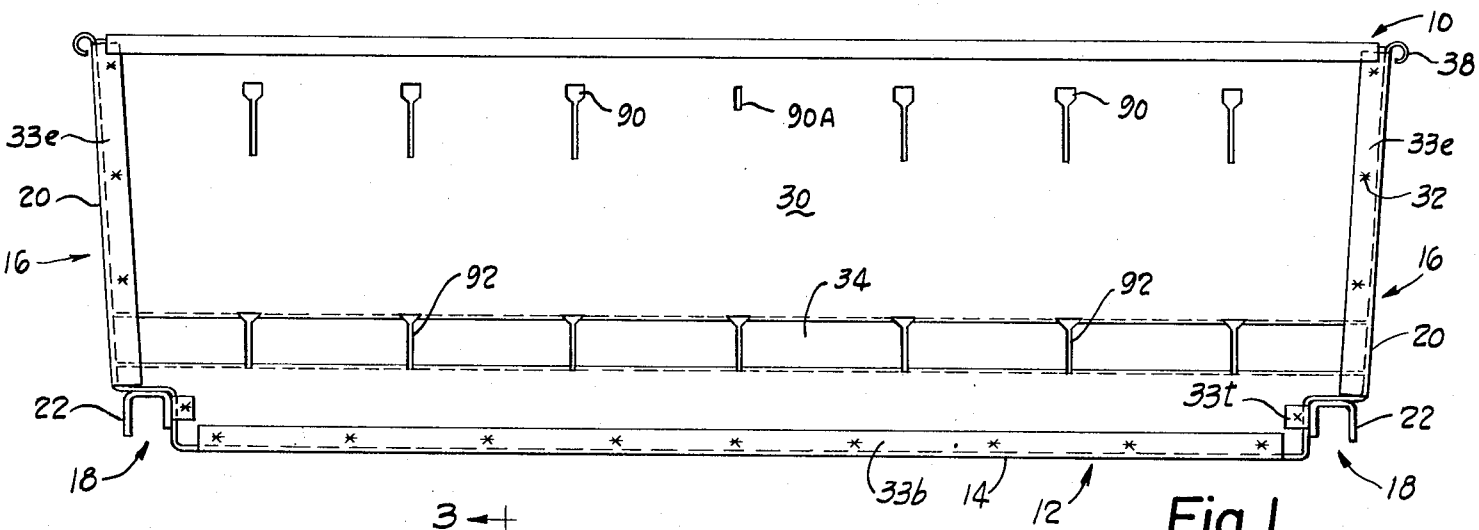
FIG. 1 is a side elevation view of the container of the present invention.
Figure 2:
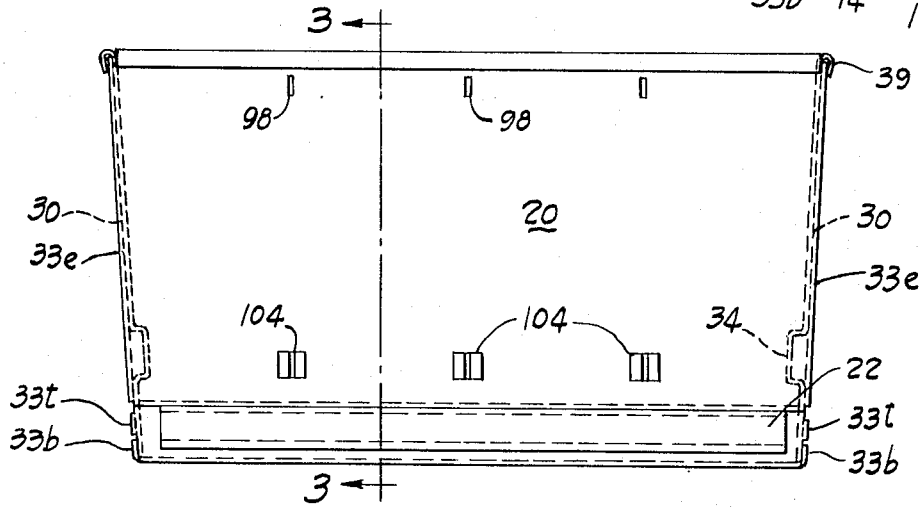
FIG. 2 is an end elevational view of the container of the present invention.
Figure 3:
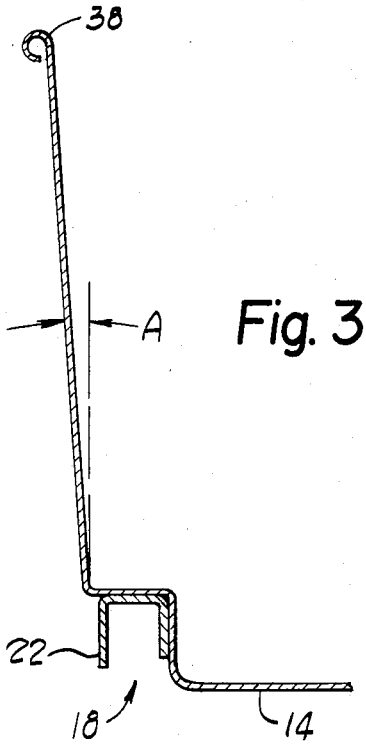
FIG. 3 is a fragmentary cross-sectional view on an enlarged scale and as seen from the plane indicated by lines 3—3 of FIG. 2.

Referring now to FIGS. 1–3, a nestable, preferably steel, container 10 includes an element 12 comprised of a bottom wall portion 14, integral, upwardly extending, end wall portions 16 and recessed portions 18. A main wall part 20 of each end wall portion 16 diverges to form an angle A with respect to a normal with the bottom wall portion 14. The angle A is approximately 2.5 degrees.

Each of the recessed portions 18 is at the bottom of a connected end of the end wall portions 16 interconnecting the end wall portion with the bottom wall portion 14. Each recessed portion is defined by a connecting wall segment that is preferably inverted L shaped in cross section having transverse and vertical portions.

Each of a pair of inverted, generally U shaped in cross section, engagement members 22 is welded within an associated one of the recessed portion 18 and does not protrude beyond an imaginary plane defined by and along each of the main wall parts 20. It is preferable that the length of engagement member 22 is less than the length of the end wall portion 16.

Side walls 30 are fixed to the bottom and end wall portions 14, 16. The side walls are welded at a plurality of locations 32 to a recess portion tab part **33*t* and flange parts 33*e* and 33*b* respectively of the end and bottom wall portions. The flange parts 33*e* and 33*b* are integrally fixed to the sides of the end walls and the sides of the bottom wall respectively. The flange parts 33*e* extend normally from the sides of the end walls toward the opposed end wall and the flange parts 33*b* extend upwardly and diverge with respect to each other. The flange parts are external of the side walls to resist outward forces imposed on the side walls by heavy parts. Thus, the welds at 32** are not subjected to the tensile forces that would be present if the side walls were exterior of the flanges.

The periphery of the side walls follows the contour of the element 12 such that the recessed portions 18 remain open to have a clear profile along the longitudinal axis of the engagement members 22. The side walls 30 diverge with respect to each other and form an angle B of approximately 2.5 degrees with respect to a normal with the bottom wall portion 14. Thus, the element 12 and the side walls 30 together define a container parts receiving volume.

Each side wall 30 has a nest effecting recess 34 spaced from the bottom wall portion 14 and extending into the interior of the parts receiving volume. The recess 34 is defined by an integral, channel-like rib that preferably runs the length of the side walls and is parallel to the bottom wall portion 14. These recesses 34 act as supports for a nestable container.

Figure 4A:
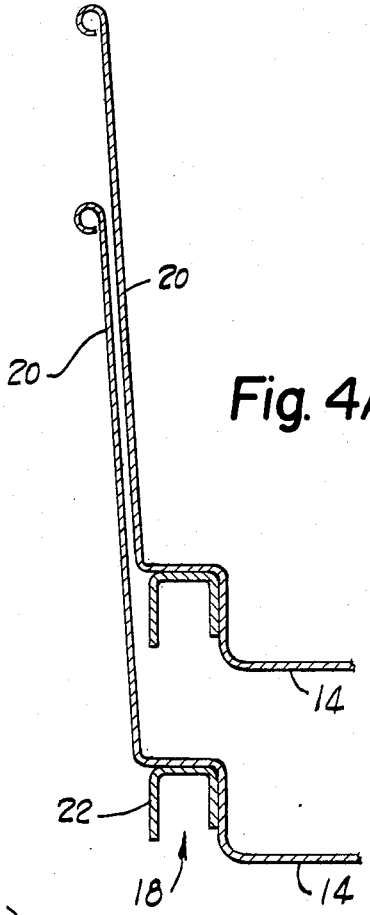
FIG. 4A is a fragmentary cross-sectional view of the end portions of several containers of the present invention nested in a stacked relationship.
Figure 4:
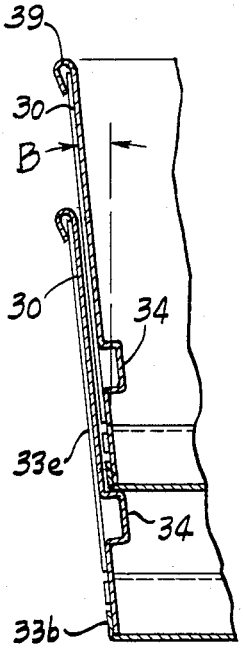
FIG. 4 is a fragmentary cross-sectional view of the side portions of several containers of the present invention nested in a stacked relationship.

Referring to FIGS. 4 and 4A, the stackability of containers made in accordance with the present invention can be appreciated. As is illustrated then, the divergance of the side and end walls permits containers of the same size and dimensions to be stacked or nested one within another. The nesting recesses or stops 34 which integrally extend into the interior of the lower container, support the upper container and prevent the containers from becoming wedged together making them difficult to separate.

The integral structure of element 12 along with the attachment of the engagement members in the recessed areas and the welding of the side walls to the end walls provides rigidity to the container. To add even more rigidity, the top parts 38 of the end walls portions 16 and top parts 39 of the side walls 30 are outwardly rolled.

Figure 5:
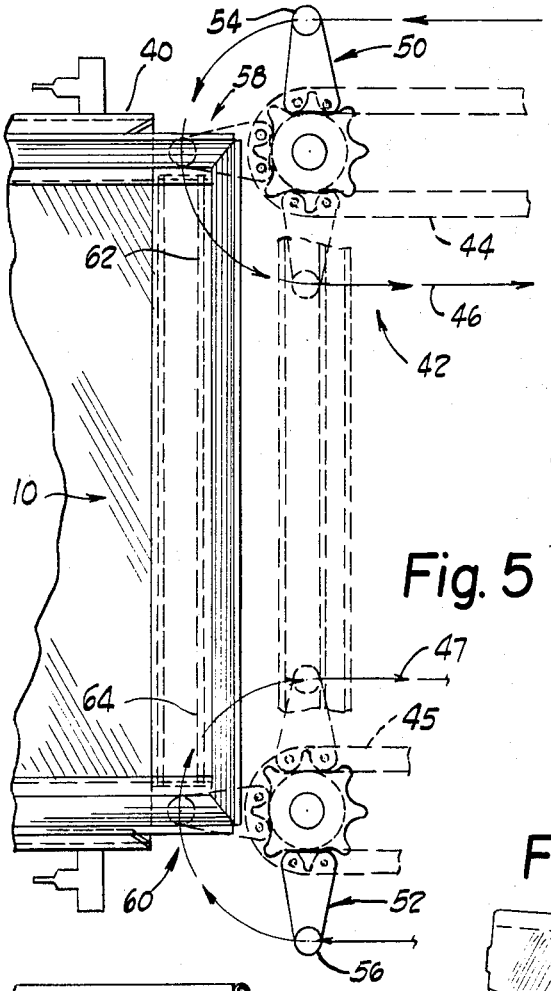
FIG. 5 is a top plan view of a portion of a container made in accordance with the present invention and a portion of a crane from an automatic storage/retrieval system.
Figure 5A:
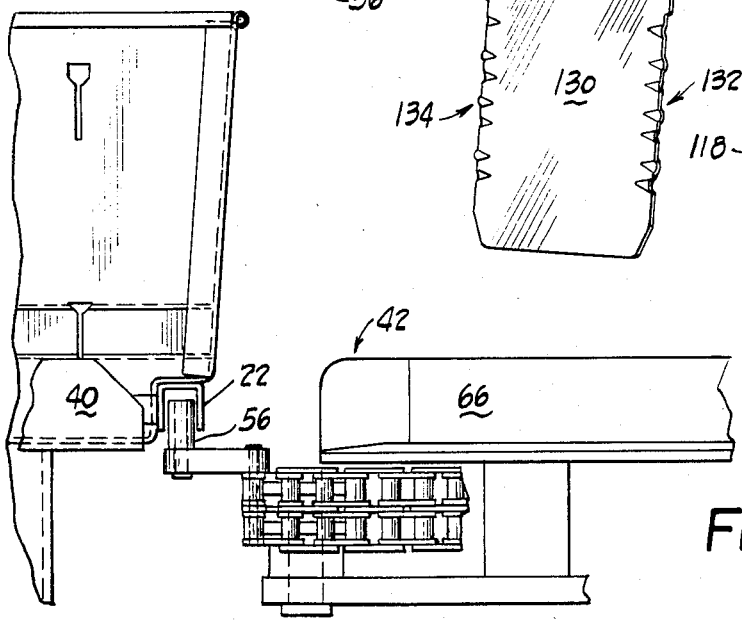
FIG. 5A is a fragmentary side elevation view of the container and crane shown in FIG. 5.

Referring now to FIGS. 5, 5A, the container 10 is shown on a support track 40 of a storage unit. A crane 42 has two sprocket drive chains 44, 45 which move along paths indicated by and in the direction of the arrows 46, 47. Secured to each of the sprocket drive chains are engagement pin assemblies 50, 52 having normally extending pins 54, 56 which are used to engage the engagement member 22 of the container 10.

In a retrieval operation, the crane 42 is commanded and moved to the location of the container 10 in the storage unit. The chains 44, 45 drive the pin assemblies 50, 52 so that the pins 54, 56 enter from the outer periphery 58, 60 of the engagement member 22 and hook or engage the outer depending wall of the engagement member approximately at locations 62, 64. The crane then pulls the container 10 onto the crane platform 66 and the crane transports the container to the desired location for removal of items or storage of more items. The replacement of the container 10 on the storage tracks 40 is simply the opposite of the retrieval system with the chains 44, 45 driving the pin assemblies 50, 52 in the opposite directions from that shown by arrows 46, 47.

Figure 6:
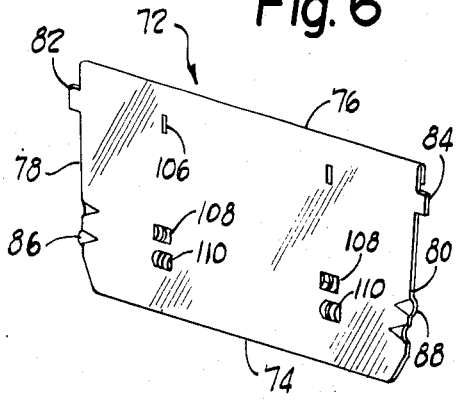
FIG. 6 is a front perspective view of a full width divider wall for use in a container made in accordance with the present invention.

Referring now to FIG. 6, a full width divider wall for use with a container made in accordance with the present invention is shown. A divider wall 72 is provided having a bottom surface 74, a top surface 76 and end surfaces 78, 80. Tabs 82, 84 and blisters 86, 88 respectively extend longitudinally and transversely from the ends of the wall 72. The tabs 82, 84 lie in the same plane as the wall.

A full width divider wall is dimensioned to fit within the interior of the container 10 and be positioned transversely to divide the space between the end walls. A full width divider wall is inserted into the interior of the container to be oriented perpendicular with respect to the side walls. Receiving slot **90*a* is provided in each side wall side to receive one of the tabs 82 or 84 and to locate and secure the divider wall into a dividing position between the end walls 16. Receiving slots 92 are provided in each side wall recesses each to receive one set of the blister 86, 88. The blisters pass through the wide top opening part of one of the slots 92 and then are located and secured in the recess 34 with a small part of the divider projecting through a narrow vertical part of the slot 92. A full width divider wall can be only centrally located within the interior of the container 10 to divide the container into two equal sections. To make the divider wall fixed in the container, the tabs 82, 84** can be bent over once the divider wall is positioned within the container.

Figure 7:
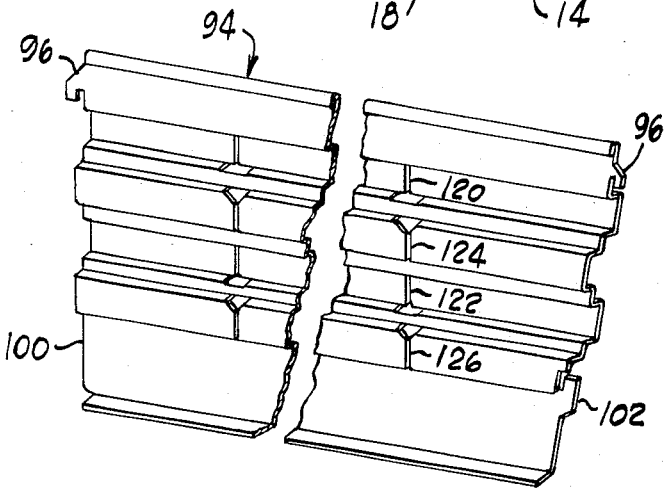
FIG. 7 is a foreshortened perspective view of a partition wall for use in a container made in accordance with the present invention.

Referring now to FIG. 7, a partition wall 94 for use with a container made in accordance with the present invention is provided. The partition wall 94 is designed to divide the container interior between the side walls. A partition wall is dimensioned to extend between one of the end wall portions 16 and the divider wall 72 of FIG. 6. The partition wall 94 has tabs 96 designed to be received in slots 98 of the end wall portions 16 and slots 106 in the divider wall. The partition wall also has flat engagement surfaces 100, 102 designed to fit within slotted guides 104 of the end walls 16 and 108, 110 of divider wall. The divider walls have receiving slots 106 and slotted guides 108, 110 on each side of the divider wall 72 which are used to locate and secure such partition walls.

Figure 8A:
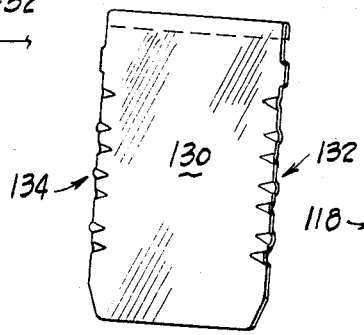
FIG. 8A is a perspective view of a sub-divider wall for dividing the space between two partition walls in a container made in accordance with the present invention.
Figure 8:
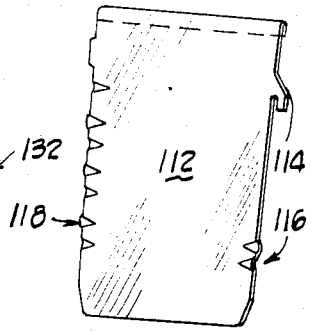
FIG. 8 is a perspective view of a sub-divider wall for dividing the space between a partition wall and a side wall in a container made in accordance with the present invention.

Referring now to FIGS. 8, 8A, sub-divider walls for use with a container made in accordance with the present invention are provided. These walls may be dimensioned to divide the portion of the container 10 between a side wall and a partition wall or between two partition walls. A plurality of combinations and permutations of divider and partition walls is possible to divide the interior parts receiving volume of the container 10 into a plurality of portions. A sub-divider wall 112 shown in FIG. 8 is used to sub-divide a space between a side wall and a partition wall. The tab 114 and blisters 116 function the same as tabs 82, 84 and blisters 86, 88 of the divider wall 72. The tab 114 is received in a slot 90 and blisters 116 are received in a slot 92. Blisters 118 are used to secure the sub-divider wall into receiving slots 120, 122, and 124, 126 of the partition wall 94. A sub-divider wall 130 shown in FIG. 8A is used to divide the space between two partition walls. Blisters 132, 134 are designed to fit within receiving slots 120, 122, and 124, 126 of two partition walls.

Like the rest of the container, the divider and partition walls are preferably made from steel. The containers 10 are shipped without the divider and partition walls being located in their partitioning position. When put in use, the divider and partition walls add rigidity to the overall container structure. The use of the walls in the division of the container interior also adds rigidity to the container. Of course, it is contemplated that the walls would be removed prior to stacking of the containers.

Although the present invention has been described with regard to two engagement members, it is possible to have only one such member per container. Also, it is not necessary that the engagment member be a single piece or continuous structure as shown. As those skilled in the art will appreciate, a container having U shaped engagement members with the channel structure at the end walls can also be moved by a conventional handling device such as a fork lift truck.

Other modifications and variations of the invention will be apparent to those skilled in the art in view of the foregoing detailed disclosure. Therefore, it is to be understood that, within the scope of the appending claims, the invention can be practiced otherwise than as specifically shown and described.

We claim:

1. A nestable container for use with automatic storage/retrieval systems comprising:

(a) a base element including a bottom wall and two diverging end walls extending upwardly from said bottom wall, said end walls and said bottom wall being one integral element;

(b) said bottom wall including integral bottom flanges extending upwardly and diverging with respect to each other;

(c) a juncture of each end wall with said base element being defined by an inverted L-shaped wall segment, said L-shaped wall segment being substantially the full width of its associated end wall, each inverted L-shaped segment defining a lower recess having depth and longitudinal dimensions substantially less than the depth and longitudinal dimensions of the adjacent side and bottom walls;

(d) each of said end walls also including end flange parts extending normally from the sides thereof and toward the other end wall;

(e) two side walls fixed to each side of said base element and welded along said end flanges and said bottom flanges, said side walls diverging with respect to each other, said bottom wall, end walls and side walls defining a container interior;

(f) each of said side walls including structure defining an upper recessed portion spaced from said bottom wall and extending into the interior of the container, toward the opposed side wall, said structure defining a nesting stop for containers of similar dimensions stacked within said container; and (g) two engagement members, one fixed in each lower recess, each engagement member including unobstructed opened ends adapted to engage a mechanical moving means forming part of the storage/retrieval system for effecting movement in said container in a transverse direction, the engagement members being respectively disposed inwardly of a plane located by an outer surface of the adjacent end wall.

2. The nestable container of claim 1 wherein said engagement members are substantially inverted U-shaped elements fixed in the lower recesses.

3. The nestable container of claim 2 wherein the length of said inverted U-shaped element is less than the length of the associated inverted L-shaped wall segment.

4. The nestable container of claim 1 wherein the upper ends of said side and end walls are outwardly rolled.

5. The nestable container of claim 1 wherein said nesting stop extends the full length of the associated side wall.

6. A nestable container for use with an automatic storage/retrieval system of the type having engagement pins movably carried by a conveyor means, the container comprising:

(a) structure defining a base and two end walls projecting upwardly from the base and diverging with respect to each other, each of said end walls being joined to said base by a connecting wall segment that is substantially inverted L-shaped in cross-section such that an outer recess is formed between each of said end walls and said base member, each outer recess extending the full width of its associated end wall having depth and longitudinal dimensions substantially less than the depth and longitudinal dimensions of the adjacent side and bottom walls;

(b) a pair of side walls fixed to each side of said structural element and defining therewith a container volume;

(c) each of said side walls including a longitudinal rib defining a nesting stop, said rib being spaced above said outer recesses;

(d) a spaced pair of pin engagement walls respectively disposed in said outer recesses, each wall depending downwardly from a transverse portion of an associated one of said inverted L-shaped walls and spaced outwardly from an upstanding portion of its associated L-shaped wall, said downwardly depending wall defining a slot-like region having opposite, pin receiving openings located near the side walls and being disposed inwardly of a plane located by an outer surface of the adjacent end wall;

(e) said downwardly depending wall providing an engagement surface for such pins of such conveyor means whereby such pins effect motion of said container in a predetermined direction.

7. The container of claim 6 wherein said downwardly depending wall forms a part of an inverted U-shaped channel member that is rigidly fixed to the inverted L-shaped connecting wall.

8. The apparatus of claim 7 wherein said U-shaped member is configured to rigidize the container.

9. The container of claim 6 wherein said rib is channel-like and defines partition structure whereby partitioning elements can be secured inside said container to subdivide the container volume.

10. The container of claim 6 wherein the length of said depending wall is less than the length of said inverted L-shaped connecting wall.

11. The container of claim 9 wherein said structure includes a plurality of slots.

12. A nestable container for use with automatic storage/retrieval systems comprising:

(a) a base element including a bottom wall and two diverging end walls extending upwardly from said bottom wall, said end walls and said bottom wall being one integral element;

(b) said bottom wall including integral bottom flanges extending upwardly and diverging with respect to each other;

(c) a juncture of each end wall with said base element being defined by an inverted L-shaped wall segment, said L-shaped wall segment being substantially the full width of its associated end wall, each inverted L-shaped segment defining a lower recess having depth and longitudinal dimensions substantially less than the depth and longitudinal dimensions of the adjacent side and bottom walls;

(d) each of said end walls also including end flange parts extending normally from the sides thereof and toward the other end wall;

(e) two side walls fixed to each side of said base element and welded along said end flanges and said bottom flanges, said side walls diverging with respect to each other, said bottom wall, end walls and side walls defining a container interior;

(f) each of said side walls including structure defining an upper recessed portion spaced from said bottom wall and extending into the interior of the container, toward the opposed side wall, said structure defining a nesting stop for containers of similar dimensions stacked within said container; and (g) two engagement members, one fixed in each lower recess, each engagement member defined by inverted U-shaped channel having opposite, unobstructed ends that open near said sidewalls, said U-shaped channel defining a guideway for engagement pins forming part of a retrieval system, the engagement members being respectively disposed inwardly of a plane located by an outer surface of the adjacent end wall;

(h) said channel members being disposed transverse to a direction of travel for said container when engaged by such retrieval system;

(i) said channel members being operative to receive such pins as such pins move transversely to such direction of travel and which are further operative to abuttably engage such pins when the pins move in said direction of travel to produce movement of said container.

* * * * *

UNITED STATES PATENT AND TRADEMARK OFFICE

CERTIFICATE OF CORRECTION

PATENT NO. : 4,534,466

DATED : August 13, 1985

INVENTOR(S) : Kenneth L. Wood and Emil C. Kovac

It is certified that error appears in the above-identified patent and that said Letters Patent is hereby corrected as shown below: Title page:

After "Inventor: Kenneth L. Wood, Santa Maria, Calif." insert --Emil C. Kovac, Canton, OH--.

Signed and Sealed this

*Nineteenth* Day of *November 1985*

[SEAL]

*Attest:*

DONALD J. QUIGG

*Attesting Officer*

*Commissioner of Patents and Trademarks*